US005933173A

United States Patent [19]

Solero

[11] Patent Number: 5,933,173

[45] Date of Patent: Aug. 3, 1999

[54] HOLDER FOR REFILLING AND PRESERVING AN INK JET PRINTHEAD

[75] Inventor: Giorgio Solero, Turin, Italy

[73] Assignee: Olivetti Lexikon S.p.A., Ivrea, Italy

[21] Appl. No.: 08/873,562

[22] Filed: Jun. 12, 1997

Related U.S. Application Data

[63] Continuation-in-part of application No. 08/622,454, Mar. 22, 1996, Pat. No. 5,821,967.

[30] Foreign Application Priority Data

Jun. 14, 1996 [IT] Italy ..... TO9600133 U

[51] Int. Cl.[6] ..... B41J 2/175

[52] U.S. Cl. ..... 347/85

[58] Field of Search ..... 347/85–87; 141/18, 141/371, 330, 348, 349, 350, 365, 366

[56] References Cited

U.S. PATENT DOCUMENTS

| | | | |
|---|---|---|---|
| 5,406,320 | 4/1995 | Durst et al. | 347/86 |
| 5,495,877 | 3/1996 | Schwenk et al. | 141/18 |
| 5,531,055 | 7/1996 | Sell et al. | 347/85 |
| 5,581,287 | 12/1996 | Baezner et al. | 347/85 |
| 5,595,223 | 1/1997 | Hayao | 141/18 |
| 5,631,681 | 5/1997 | Klaus et al. | 347/85 |

FOREIGN PATENT DOCUMENTS

| | | |
|---|---|---|
| 0568124 | 11/1993 | European Pat. Off. . |
| 0633137 | 1/1995 | European Pat. Off. . |
| 0638427 | 2/1995 | European Pat. Off. . |
| 0672527 | 9/1995 | European Pat. Off. . |

*Primary Examiner*—N. Le
*Assistant Examiner*—Judy Nguyen
*Attorney, Agent, or Firm*—Banner & Witcoff, Ltd.

[57] ABSTRACT

A holder (10) for refilling an ink jet printhead (11) comprises a box (21) and two covers (22, 23), pivoted upwardly on the box (21) for being rotatable reciprocally and with respect to the box (21). A first cover (22) is provided for positioning and locking the printhead (11) into the box (21). A second cover (23) is superimposable to the first cover (22) and is provided with a seat (30) for being coupled with a refill cartridge (34) so as to refill the printhead (11). A short tube (31) is mounted in the second cover (23) inside the seat (30) to allow ink to pass from the cartridge (34) to the printhead (11) for refilling the latter. Pivoting of the two covers (22 and 23) allows simple and exact positioning of the same covers with respect to the printhead (11), first to lock it into the box (21) and then to fill the printhead (11) with ink. According to another embodiment (20), an upper cover (123) provides sliding support for a sliding member (60) bearing a short tube (131). When the upper cover (123) is rotated and closed on a box (121), one end (133) of the tube (131) is brought into contact, without forcing it, with a sealing element (65) which seals a refill hole (18) in the printhead. Subsequently, the cartridge (34) is pushed against another end (132) of the tube (131), resulting both in the tube (131) perforating the cartridge (34) and also expelling the sealing element (65) from the refill hole (18), thus allowing ink to be transferred from the cartridge (34) to the head (11) through the tube (131).

13 Claims, 2 Drawing Sheets

HOLDER FOR REFILLING AND PRESERVING AN INK JET PRINTHEAD

CROSS REFERENCE TO RELATED APPLICATION

This application is a continuation-in-part of the actually pending application having U.S. patent application Ser. No. 08/622,454, filed on Mar. 22, 1996, now U.S. Pat. No. 5,821,967.

FIELD OF THE INVENTION

The present invention relates to a holder for refilling an ink jet printhead by means of a refill cartridge, comprising a box for removably housing the printhead.

BACKGROUND OF THE INVENTION

Ink jet printheads are commonly used in various printing devices, in which the ink jet printheads are generally mounted on a print carriage that is movable with respect to a print line. An example of these printheads is described in the U.S. Pat. No. 5,119,115. In particular, each printhead is provided with a tank which is filled with ink and which becomes empty in consequence of emission of droplets of ink from nozzles of the printhead.

In order to increase the operative life of printheads, the latter are refilled several times by filling up their tank with fresh ink. Normally refilling is performed by means of a cartridge containing ink and by transferring the ink from the cartridge into the tank of the printhead through a refill hole which is generally disposed on an outer surface of the printhead, usually opposite the side on which the nozzles are provided.

It is known a holder adapted for facilitating refilling of ink jet printheads, which comprises a box in which the printhead is housed and a cover which is removably mounted on a top of the box. The cover is provided with a tube which, when the cover is mounted on the top of the box, is positioned with respect to the printhead housed into the box, so that an end of the tube enters into the refill hole of the printhead and another end of the tube is disposed towards the outside of the holder for being coupled with the cartridge and so reaching the ink contained in the same cartridge. In this manner, the tank of the printhead is put in communication with the ink contained in the cartridge, for causing the ink to pass through the tube from the cartridge to the tank, so as to refill the printhead.

In this known holder the cover is separate from the box and, therefore, the cover is completely removed from the box each time the printhead has to be housed inside the holder for being refilled.

Consequently, this holder is uncomfortable to use and requires a certain manual skill in mounting and correctly positioning the cover on the box for precisely positioning the tube with respect to the refill hole of the printhead housed in the box.

SUMMARY OF THE INVENTION

The purpose of this invention is to obtain a holder for refilling an ink jet printhead that is easier and more practical to use than those known in the state of the art described above.

This purpose is reached by a holder according the present invention, which comprises a first cover suitable of assuming a locking position on the box for positioning and locking the printhead into the box, a second cover, and a tube mounted on the second cover and having a first end for entering into the refill cartridge for allowing the passage of ink from the latter to the printhead and a second end for entering into the printhead, wherein the tube is exactly positioned with respect to a predetermined part of the printhead lodged in said box, when the first cover is in the locking position and the second cover is superimposed to the first cover, and is characterized in that the first cover is pivotably mounted on the box and is rotatable from a rest position to its locking position; and in that the second cover is pivotable with respect to the box for being superimposed to the first cover.

A first preferred embodiment of the holder having the above identified features will be described later.

A further purpose of the invention is to provide a holder for refilling an ink jet printhead which is adapted not only for refilling the printhead, but also for housing and preserving the latter during the periods in which the printhead is not used for printing, so as to be able to maintain its level of performance between one printing job and the next.

A second preferred embodiment of the holder directed specifically to reach this further purpose will be described later, wherein the holder is adapted for retaining, during such periods, the printhead with its nozzles and tank remaining perfectly sealed, to avoid drying of the ink in the vicinity of the nozzles and evaporation of the ink contained in the tank inside, and in the same time keeps the printhead inside a substantially enclosed environment, isolating and protecting it from the surrounding environment.

In particular, the second embodiment is provided for avoiding some drawbacks of the first embodiment which render the latter not adapted for preserving the printhead. These drawbacks of the first embodiment consist, for example, in that the closure of the cover on which the tube is fitted results in the latter penetrating the head housed inside the holder, whereby sealing of the tank in the head is no longer assured, and moreover in that if, in an attempt to avoid the tube penetrating the head, the cover is not fully closed on the box, whereby, because of this imperfect closure, a closed protective volume is no longer created around the printhead and the printhead is not isolated from the surrounding atmosphere.

According to the second embodiment, the holder is characterized by a sliding element rigidly attached to the tube and fitted in sliding manner on the second cover, wherein the sliding element is being suitable for assuming, when the printhead is housed in the box, the first cover is in the locking position and the second cover is superimposed to the first cover, a first rest position in which the second end of the tube is seated upon a sealing member of the refill hole of the printhead, and of assuming, when the refill cartridge is pressed with a given force against the first end of the tube, a second working position in which the first end perforates a membrane of the cartridge and the second end expels the sealing element from the refill hole and passes through the latter, thereby allowing transfer through the tube of the ink contained in the refill cartridge from the latter to the printhead.

BRIEF DESCRIPTION OF THE DRAWINGS

These and other characteristics and advantages of the present invention will be clear from the following description of the preferred embodiments of the present invention which are given by way of a non-limiting example, with reference to the accompanying drawings, in which.

DETAILED DESCRIPTION OF THE PREFERRED EMBODIMENTS OF THE INVENTION

First Embodiment

Figure 1:
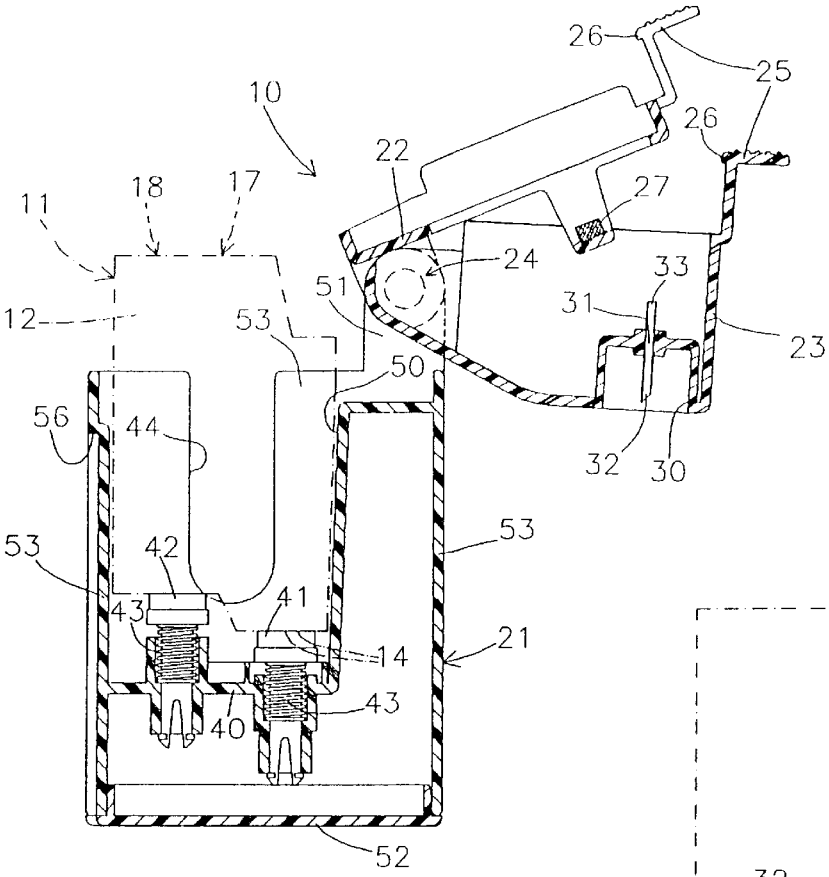
FIG. 1 is a lateral cross-sectional view of a first embodiment of a holder for ink jet printheads in accordance with the present invention, in a rest position.

With reference to FIG. 1, a holder 10 for an ink jet printhead 11, according to the present invention, has a substantially parallelepipedal shape and comprises a box 21 and an upper part, which is constituted by two covers 22 and 23, respectively named first cover and second cover. The box 21 has a base 52 and four sides 53 which extend upwardly from the base 52 and which define a cavity 50. The sides 53 have an upper edge which define an aperture for entering the cavity 50. The covers 22 and 23 are pivoted, by means of a hinge 24, on parts 51 projecting upwardly from two sides 53. The hinge 24 defines a pivoting axis which is the same for the covers 22 and 23.

The first cover 22 can be selectively rotated with respect to the box 21 from a rest position, in which it does not close the aperture of the cavity 50 and permits the printhead 11 to be introduced 11 into the box 21, and a locking position in which it closes the aperture of the cavity 50 for locking the printhead 11 into the box 21.

Figure 2:
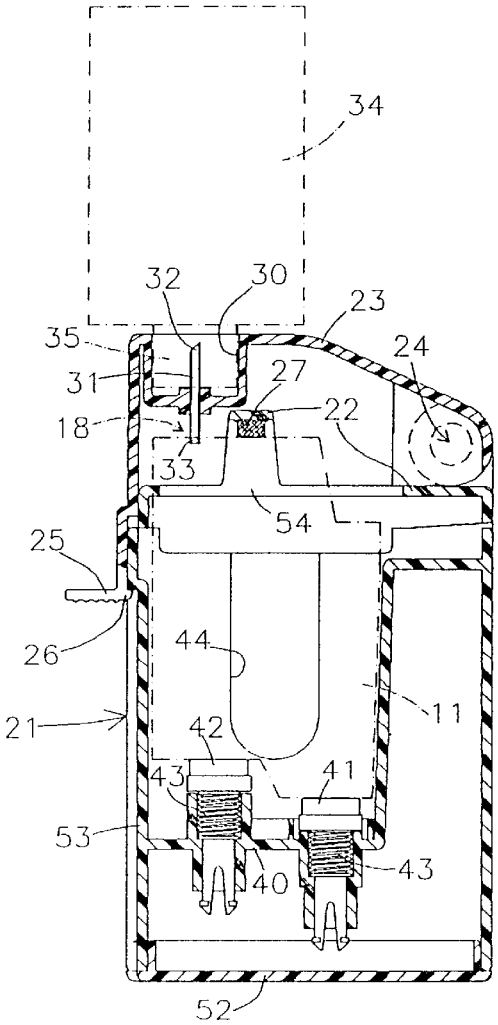
FIG. 2 is the holder of FIG. 1 in an operating position.

The second cover 23 is rotatable independently from the first cover 22 with respect to the box 21 and can be superimposed to the first cover 22, in particular when the latter is in the locking position shown in FIG. 2

The printhead 11 is shown schematically with a broken, dotted line and has a body 12, an internal tank for containing ink, a lower face bearing nozzles 14 for emission of the ink and an upper face in which a hole 17 is normally provided for putting in communication the interior of the printhead 11 with the outside. The hole 17 has the scope of maintaining the ink contained in the tank at a predetermined pressure with respect to the external atmospheric pressure. Moreover a refill hole 18 normally is provided on the upper face, which refill hole 18 is in communication with the tank inside the printhead 11 for allowing the refilling of the tank with fresh ink, as will be described later.

One side 53 of the box 21 is provided with a vertically-oriented aperture 44 which, when the printhead 11 is housed into the box 21, can allows observation of the ink inside, for example through transparent areas in the body 12 of the print head 11 or by some other means. This aperture makes it possible to visually control refilling of the head 11 with ink during the refill process.

The first cover 22 has a lower edge having a shape which substantially follows the profile of the of the upper edge of the box 21. The first cover 22 is also provided along its sides and adjacently to its lower edge with two ribs 54 for cooperating with the upper face of the printhead 11, when the latter is into the box 21. Only one of the ribs 54 is shown in the drawings since these ribs are located symmetrically with respect to the cross plane defining the sectional views of FIGS. 1 and 2.

Moreover the two covers 22 and 23 are each provided, at their ends opposite to the hinge 24, with a tab 25 which can be manually operated to selectively rotate them. For hooking the covers 22 and 23 with respect to the box 21, both first cover 22 and second cover 23 are provided with a tooth 26 which is engageable with a single shoulder 56 in the box 21.

When the covers 22 and 23 are hooked to the box 21, the respective tabs 25 are perfectly aligned and permit a quick, easy and selective unhooking of the covers 22 and 23 from the box 21 for rotation in a clockwise direction (FIG. 1 and FIG. 2).

Similarly, hooking of the covers 22 and 23 to the box 21 is also very easy and fast, and does not require complex manipulations of the covers 22 and 23 as in the known art.

Arranged on the cover 22 is a rubber element 27 which, when the printhead 11 is housed in the box 21 and the cover 22 is rotated in its locking position, urges against the same printhead 11 in correspondence of its communication hole 17. In this way the rubber element 27 is able to close the communication hole 17 of the printhead 11 for controlling the pressure of the ink inside the tank, so as to prevent undesirable leakage of ink during and after ink refilling.

The second cover 23 is shaped as a dome having upwardly a seat 30 for receiving a tip 35 of a cartridge 34 which is filled with ink and which is employed for supplying this ink to the printhead 11 housed in the box 21. Similarly to the printhead 11, the cartridge 34 is represented schematically with a broken, dotted line.

A straight and short tube 31 is fixly mounted to the cover 23 and passes through the latter for extending outwards from opposite sides of the cover 23. The tube 31 has two ends 32 and 33, which protrude respectively into the seat 30 and towards the cavity 50 of the holder 10, when the cover 23 is hooked to the box 21 (FIG. 2).

The seat 30 is open towards the outside of the holder 10 to receive the tip 35 of the cartridge 34. The end 33 of tube 31 has a flat shape and is operable for removing a closing element which obstructs the refill hole 18, so allowing the end 33 itself to pass through the hole 18 and to enter the tank of the printhead.

The end 32 of tube 31 is tapered so as to be able to perforate the tip 35 which is of a resilient material. In this way the ink inside the cartridge 34 is put in communication with the tank in the printhead 11. The ink in the cartridge 34 can thus pass through the tube 31 and refill the tank into the printhead 11, either for the effect of gravity and/or of a slight depressure inside the tank.

The box 21 has in its cavity 50 a bottom 40 in which two rubber caps 41 and 42 are elastically mounted. A first rubber cap 41 has substantially the scope of abutting against the nozzles 14 so as to seal them during refilling of the printhead 11, while the second rubber cap 42 is provided for operating as a further, resilient support of the lower face of the printhead 11, when the latter is housed in the holder 10. The rubber caps 41 and 42 are supported by corresponding springs 43, which are arranged between the same rubber caps 41 and 42 and the bottom 40. The springs 43 are subject to yield when the printhead 11 is pushed towards the bottom 40 by the ribs 54 of the first cover 22 for locking and positioning exactly the printhead 11 into the box 21. This yielding happens in correspondence of the final portion of the rotation of the first cover 22 for reaching its locking position and is activated by the entering into contact between the printhead 11 and the ribs 54.

It is clear that the distance which extends between the rubber caps 41 and 42 and the first cover 22, when no printhead is housed into the box 21 and the first cover 22 is hooked to the box 21, is slightly less than the distance between the upper and lower faces of the printhead 11 which have to be engaged by the rubber caps 41 and 42 and the cover 22 respectively. Consequently, when the cover 22 is rotated in its locking position above the printhead 11 housed in the box 21, the rubber caps 41 and 42 yield opposing the action of the spring 43 and, advantageously, the same rubber caps 41 and 42 seal the nozzles 14 through a force having an exact value defined by the yielding of the springs 43.

In a variant of the first embodiment which is not shown in the drawings as being obviously deducible from them, the rubber cap 41 and the corresponding spring 43 are not provided, and the nozzles 14 are sealed during the ink refilling by a cap supported by the printhead.

In the first embodiment of the holder 10 described above, both the covers 22 and 23 are pivoted on the box 21. However it is evident that the same inventive concept applied by this first embodiment, can serve to define other embodiments of the holder 10. As a non-exhaustive example, one only of the covers 22 and 23 may be pivoted on the box 21, whilst the other cover may be pivotally supported by that one only. Otherwise, the other cover may be linked to that one only cover in a way different from pivoting, for example, the other cover may be detachable for being completely removed from the box 21 each time that the printhead 11 has to be lodged inside.

Second Embodiment

In the description of the second embodiment, the parts also present in the first embodiment will be indicated with the same numbers as used therein increased by 100.

Figure 3:
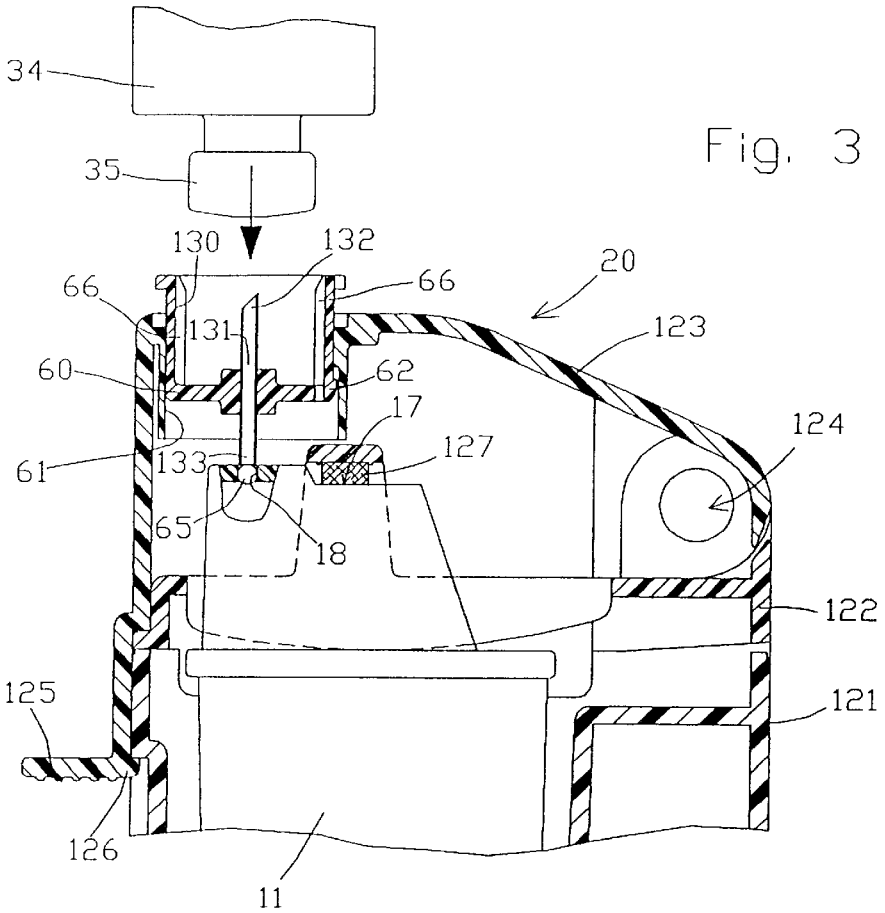
FIG. 3 is a partial, lateral cross-sectional view and in an enlarged scale with respect to the first embodiment, of a second embodiment of the holder for an ink jet printhead according to the invention, when it is in a first rest position.

With reference to FIG. 3, the holder of the second embodiment is indicated with 20 and comprises, similarly to the first embodiment, a box 121 open at the top and two covers, respectively a lower cover 122 and an upper cover 123, fulcrum-mounted with respect to the box 121 by means of a hinge 124 in such a way as to be rotated and laid one on top of the other.

The covers 122 and 123 are capable of being selectively rotated with respect to the box 121 from an open position, in which they do not obstruct the aperture of the bottom part 21 and allow introduction of the head 11 in the box 121, to a closed position in which they are disposed over the said aperture.

Figure 4:
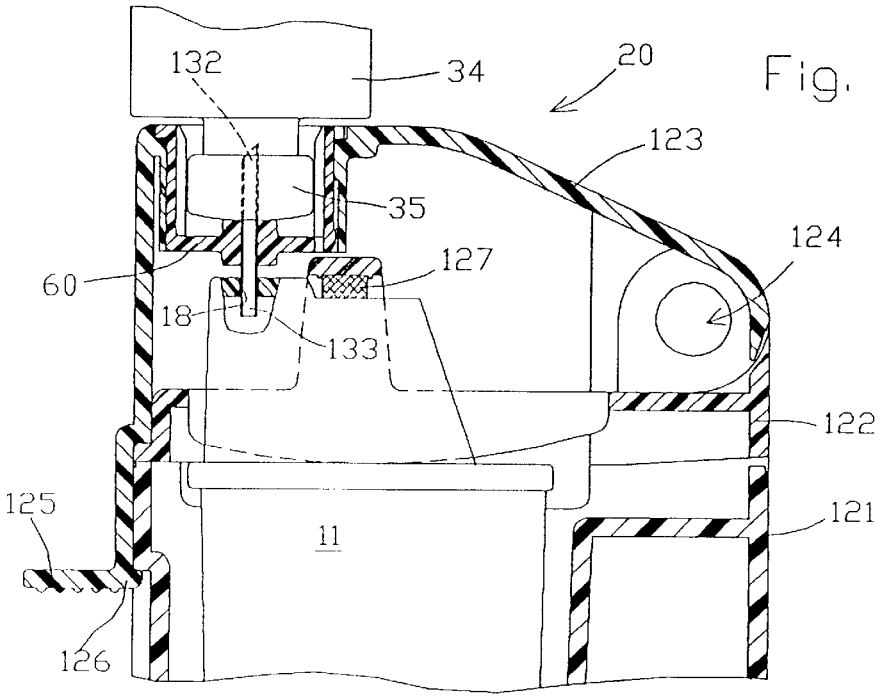
FIG. 4 is the holder of FIG. 3, when it is in a second working position.

The front face of the printhead on which there are provided the nozzles for expelling the ink is not shown on FIGS. 3 and 4, which represent only the rear face of the printhead 11 with the refill hole 18. The latter, as already described, is provided to grant access to a tank inside the head for the purpose of refilling it with ink, and is normally sealed by a sealing element 65, except during the refilling operations.

The cover 123 is dome-shaped and thus, when closed on the box 121, creates a volume around the printhead seated in the holder, substantially isolated from the external environment. This volume is designed to guarantee preservation of the printhead 11 for even lengthy periods, so that their is no impairment of its characteristics, for example following evaporation of the ink it contains.

According to one characteristic of the second embodiment, fitted on the upper cover 123 is a sliding element 60, which slides on the cover 123 and attached to which is a tube 131 having a first end 132 and a second end 133.

The sliding element 60 is provided with a seat 130 for receiving the cartridge 34. The seat 130 has guide elements 66 and is adapted for receiving and guiding the tip or membrane 35 of the refill cartridge 34 intended for refilling with ink the head 11 seated in the holder 20.

The sliding element 60 is suitable for sliding on a guide 61 of the cover 123 and is provided with three resilient teeth 62, of which only one is shown on the drawings, suitable for bending to allow the sliding element 60 to fit into the corresponding guide 61. Each tooth 62 is so shaped as to form an abutment which prevents the sliding element 60 from disengaging from the upper cover 123 and which is adapted for engaging with a corresponding abutment of the cover 123 to restrict sliding movement in one direction of the sliding element 60 with respect to the upper cover 23.

The method of operation of the device is as follows. Firstly, after the printhead 11 has been placed in the box 121, the covers 122 and 123 are rotated with respect to the box 121 by serving of tabs 125 (only one is shown) and are closed and locked on the box 121 by means of tooth 126. In the same time, a rubber element 127 fixed on the lower cover 123 seals the communication hole 17 provided on the printhead 11 for controlling the ink pressure inside the latter during refilling.

Following this operation as represented in FIG. 3, the end 133 of the tube 131 is placed precisely against the sealing element 65, without exerting any appreciable force on the latter. In fact, the sliding engagement of the sliding element 60 on the upper cover 123, causes the tube 131 to slide with respect to the cover 123, should the end 133 come into contact with the sealing element 65 before the cover 123 has been fully rotated and closed on the box 121.

Following this, as illustrated in FIG. 4, the membrane 35 of the cartridge 34 is inserted in the seat 130, where it is pushed against the end 132 of the tube 131. This results in perforation of the membrane 35 and penetration of the hole 18 by the end 133. In other words, the sealing element 65 is expelled from the refill hole and pushed towards the inside of the head 11 and the tube 131 passes through the refill hole 18.

In this way, the ink in the cartridge 34 is put in condition to be transferred through the tube 131 from the cartridge 34 to the head 11.

Subsequently the refill cartridge 34 is removed from the seat 130 and the cover 123 is rotated upwards, so that the tube 131 comes out of the printhead 11, liberating the refill hole 18. Immediately afterwards, the latter is sealed again with a new sealing element 65.

At this point the head 11 is refilled with ink and may be removed from the box 121 for use immediately in printing, or may be left in the holder 20 for preservation purposes, in which case the cover 123 is again closed over the box 21.

It is evident that various changes and/or improvements may be made to the holder for refilling the ink jet printhead corresponding to the preferred embodiments described in the foregoing without departing from the scope of the present invention.

Having thus described my invention, what I claim is:

1. A holder (20) for preserving and refilling an ink jet printhead (11) by means of a refill cartridge (34), said ink jet printhead (11) having a refill hole (18) sealed by a sealing member (65) and said refill cartridge (34) being closed by a membrane (35), said holder (20) comprising:

a box (121) for housing said printhead (11);

at least one cover (123) hinged on said box (121) for being arranged in an open position permitting said printhead

(11) to be housed in said box (121), and in a closed position in which said at least one cover (123) is closed on said box (121);

a sliding element (60) supported in sliding manner on said at least one cover (123); and a tube (131) rigidly attached on said sliding element (60) and having a first end (132) adapted for engaging with said membrane (35) of said refill cartridge (34) and a second end (133) adapted for engaging with said refill hole (18) of said printhead (11);

said sliding element (60) being provided for assuming, when said printhead (11) is housed in said box and said at least one cover (123) is in said closed position, a first rest position in which said second end (133) of the tube (131) is seated upon said sealing member (65), and for assuming, when said refill cartridge (34) is pressed with a given force against said first end (132) of the tube (131), a second working position in which said first end (132) perforates said membrane (35) and said second end (133) passes through said refill hole (18) so as to expel said sealing element (65) from said refill hole (18), thereby allowing the ink contained in said refill cartridge (34) to be transferred in said printhead (11) through said tube (131).

2. A holder (20) for refilling, by means of a refill cartridge (34) provided with a sealing membrane (35), an ink jet printhead (11) provided with a refill hole (18) sealed by a sealing member (65), said holder comprising:

a box (121) for removably lodging said printhead (11);

a first cover (122) pivotably mounted on said box (121) and rotatable from an open position, in which said first cover (122) allows said printhead (11) to be lodged in said box (121), to a locking position, in which said first cover (122) is closed on said box (121) and positions and locks said printhead (11) into said box (121);

a second cover (123) pivotable with respect to said box (121) for being superimposed to said first cover (122);

a sliding element (60) supported in sliding manner on said second cover (123); and a tube (131) rigidly attached on said sliding element (60), said tube (31) having a first end (132) for entering into said refill cartridge (34) and a second end (133) for entering into said printhead (11);

wherein said sliding element (60) assumes, when said printhead (11) is housed in said box (121), said first cover (122) is in said locking position and said second cover (123) is superimposed to said first cover (122), a first rest position in which said second end (133) of the tube (131) is seated upon said sealing member (65), and moreover wherein said sliding element (60) assumes, when said refill cartridge (34) is pressed with a given force against said first end (132) of the tube (131), a second working position in which said first end (132) perforates said membrane (35) of said cartridge (34) and said second end (133) passes through said refill hole so as to expel said sealing element (65) from said refill hole (18), thereby allowing the ink contained in said refill cartridge (34) to be transferred through said tube (131) in said printhead (11).

3. A holder (20) according to claim 2, wherein said sliding element (60) comprises a seat (130) provided for removable housing said refill cartridge (34) and arranged adjacently to said tube (131), whereby said refill cartridge (34) is positioned with respect to said tube (131), when said cartridge (34) is housed into said seat (130).

4. A holder (20) according to claim 3, wherein said first end (132) of said tube (131) is lodged within said seat (130).

5. A holder (20) according to claim 2, wherein said first (122) and second (123) covers are both pivoted about a same axis on two lateral projections of said box (121).

6. A holder (20) according to claim 2, wherein said printhead (11) has an internal tank and said refill hole (18) is communicating with said tank, said second end (133) of said tube (131) being provided for entering into said tank through said refill hole (18).

7. A holder (20) according to claim 6, wherein said printhead (11) has another hole (17) for maintaining the pressure of the ink into said tank at a predetermined value, said first cover (122) having means (127) for sealing said another hole (17) when said printhead (11) is lodged into said box (121) and said first cover (122) is in said locking position.

8. A holder (20) according to claim 2, wherein each of said covers is provided with a manually actionable tab (125), and the tab of said first cover (122) is substantially aligned with the tab of said second cover (123) when said first cover is in said locking position and said second cover (123) is superimposed to said first cover (122).

9. A holder (20) according to claim 8, wherein said box (121) is provided with a locking shoulder and wherein each (122, 123) of said covers is provided with a tooth (126) engageable with said locking shoulder.

10. A holder (20) according to claim 2, wherein said printhead (11) is provided with a plurality of nozzles (14) and said holder (20) comprises at least one elastic member mounted on an internal bottom of said box (121), and wherein, when said printhead (11) is lodged in said box (121) and said first cover (122) is in its locking position, said at least one elastic member supports said printhead in the region of said nozzles (14) in order to seal them, and moreover said first cover (122) urges said printhead (11) against said at least one elastic member.

11. A holder (20) according to claim 2, in which said second cover (123), when it is in said closed position and said printhead (11) is housed in said box (121), defines in conjunction with the latter a substantially enclosed space around the printhead (11) housed in the box (121) to protect it from the surrounding environment during preservation in the holder (20).

12. A holder (20) according to claim 2, wherein said second cover (123) comprises a guide (61) from which said sliding element (60) is slidingly supported, and moreover comprises a first abutment along said guide (61), and wherein said sliding element (60) comprises resilient teeth which form a second abutment, said resilient teeth defining fastening means for fastening said sliding element (60) with said second cover (123) and being provided for bending when said sliding element (60) is initially fitted on said guide (61), and said second abutment of said resilient teeth being adapted for engaging with said first abutment of said guide (61) in order to restrict the extent of travel of said sliding element (60) along said guide (61).

13. A method for refilling an ink jet printhead (11) with the use of a holder (20) and of a refill cartridge (34) closed by a membrane (35), wherein said ink jet printhead (11) is provided with a refill hole (18) sealed by a sealing element (65), and said holder (20) comprises:

a box (121);

at least one cover (123), hinged on said box, provided for being lifted from said box (121) to permit housing of said printhead (11) in said box, and moreover provided for being closed on said box (121);

a sliding element (60) supported in sliding manner on said at least one cover (123); and a tube (131) rigidly attached on said sliding element (60), and having a first end (132) suitable for engaging with said membrane (35) and a second end (133) suitable for engaging with said refill hole (18) of said printhead (11);

said method comprising the following steps:

housing said printhead in said box (121);

closing said at least one cover (123) on said box (121) in such a way as to seat said second end (133) of said tube (131) on said sealing element (65) and place said sliding element (60) in a first rest position; and pressing said refill cartridge (34) with a given force against said first end (132) of said tube (131) to make said sliding element (60) slide from said first rest position to a second working position with respect to said at least one cover (123), so as to have said first end (132) perforate said membrane (35), and moreover to have said second end (133) pass through said refill hole (18) and hence expel said sealing element (65) from said refill hole (18), whereby the ink contained in said refill cartridge (34) is allowed to be transferred in said printhead (11) through said tube (131).

* * * * *